United States Patent [19]

Hunt

[11] 4,243,014

[45] Jan. 6, 1981

[54] COMBUSTION CHAMBER CONSTRUCTION

[75] Inventor: Lloyd P. Hunt, Bridgeton, Mo.

[73] Assignee: Johnson Heater Corp., Bridgeton, Mo.

[21] Appl. No.: 71,317

[22] Filed: Aug. 30, 1979

[51] Int. Cl.[3] ..... F24H 9/14; B21D 53/00; F16L 41/00

[52] U.S. Cl. ..... 126/119; 29/157.5; 29/512; 126/98; 126/104 R; 165/76; 285/222; 285/382.5

[58] Field of Search ..... 285/222, 382.4, 382.5; 29/157.4, 157.5, 512; 165/76, 79; 126/119, 104 R, 98, 60, 61, 108, 64

[56] References Cited

U.S. PATENT DOCUMENTS

| | | | |
|---|---|---|---|
| 695,614 | 3/1902 | Lape | 285/382.5 |
| 880,217 | 2/1908 | Jameson | 126/119 |
| 1,438,596 | 12/1922 | Harding | 285/382.5 |
| 1,880,638 | 10/1932 | Wood | 285/334.5 |
| 2,166,890 | 7/1939 | Desmond | 29/157.5 |
| 2,711,127 | 6/1955 | O'Day | 285/222 |
| 2,984,235 | 5/1961 | Johnson et al. | 126/104 R |
| 3,766,631 | 10/1973 | Scheitlin | 29/512 |
| 3,940,837 | 3/1976 | Wiese | 126/119 |
| 3,980,629 | 9/1975 | Wiese | 126/119 |
| 4,195,943 | 4/1980 | Williams | 285/222 |

*Primary Examiner*—James C. Yeung
*Assistant Examiner*—Daniel O'Connor
*Attorney, Agent, or Firm*—Cesari and McKenna

[57] ABSTRACT

An improved combustion chamber comprises a shell having a circular array of integral teeth formed at one end thereof. Shrunkfit onto said shell end at or near the roots of the teeth is a ring. The toothed end of the shell is received in an opening in a sheet header so that the ring engages against the header sheet and a continuous weld bead is formed between the ring and the header sheet all around the shell. The shell teeth are bent radially outward and engage the header sheet on the opposite side thereof from the ring so as to be in intimate thermal heat exchange contact with the sheet and these teeth are also welded to the header sheet. The aforesaid engagement between the chamber and rear head minimizes stresses on hot end of the chamber and prolong its useful life. Means engaged around the opposite end of the shell supports, and yet permits lengthwise movement of, that end of the shell.

3 Claims, 4 Drawing Figures

COMBUSTION CHAMBER CONSTRUCTION

This invention relates to hot air heaters. It relates more particularly to an improved combustion chamber construction for such heaters.

BACKGROUND OF THE INVENTION

The combustion chambers with which we are concerned here are of the tubular shell variety. In order to better withstand the corrosive effects of combustion gases, these combustion chambers are very often made of stainless steel which material has a relatively large coefficient of thermal expansion. Accordingly, the combustion chambers are prone to undergo longitudinal and radial expansions and contractions as the heater is turned on and off to meet the demands of the space being heated.

The combustion chamber is usually supported at its rear end through a sheet header which also communicates with heat exchange tubes so that hot combustion products produced in the combustion chamber by the burner can pass from the combustion chamber through the header and heat exchange tubes to the flue. Fresh air, on the other hand, is drawn into the heater, is circulated around the combustion chamber and heat exchange tubes to heat it and then the heated air is discharged into the space directly or by way of ducts. It is essential then that the joint between the rear end of the combustion chamber and the header be completely fluid-tight so that no combustion products can be entrained in the air being expelled by the heater into the living space.

Since the headers and fire tubes are subjected to lower temperatures than the combustion chamber, it is customary to construct them out of a material other than stainless steel, carbon steel for example, which has a different coefficient of thermal expansion. Consequently, when the heater cycles between its high and low temperature extremes, the combustion chamber and the headers expand by different amounts. For that reason, it has proven difficult to provide a fluid-tight joint between the combustion chamber and the rear header which will maintain its integrity despite repeated temperature cyclings of the heater.

One technique for solving this problem is disclosed in U.S. Pat. No. 2,984,235. It involves the providing of a ring around the rear end of the combustion chamber, which ring is welded to the rear header sheet and to the combustion chamber wall at spaced-apart locations such that during thermal cyclings of the heater, the ring is able to roll to relieve stresses on the circular welds caused by the differential expansion and contraction movements of the header and the chamber. In another prior construction, the ring is shrunk fit onto the chamber and a single weld bead connects the ring to the rear header sheet. Both those conventional joints have a serious disadvantage, however, in that the end of the combustion chamber extends through the header sheet and cannot reject heat efficiently to the cooler surfaces of the header sheet. Resultantly, it is heated excessively causing high stresses which give rise to potential failures of the fluid-tight joint between the chamber and header which can shorten the useful life of the heat exchanger as a whole.

Also, because the ring welded between the combustion chamber and the header is positioned on the side of the header sheet away from the chamber, care must be taken to ensure that the chamber cannot pull out of the header sheet in the event of excessive lengthwise contraction of the chamber relative to the header. In the past, this has been accomplished by fitting ring segments having a square cross-section around the end of the chamber on the opposite side of the rear header sheet from the round ring and welding the square ring segments to the end of the chamber. The segments act as abutments to minimize any likelihood of the combustion chamber pulling out of the rear header sheet.

In addition to that, a series of metal straps whose opposite ends are connected to the rear header sheet and to the combustion chamber, respectively, are distributed around the joint between those two elements to further eliminate the possibility of the chamber pulling out of the header and falling down into the heater. While those safety precautions have eliminated the problem of combustion chamber pull-out at the rear end of the chamber, they require a relatively large number of cutting and welding steps.

The seal between the forward, cooler end of the combustion chamber and its support has not been totally satisfactory either because some fluid leakage still occurs from the interior of the heater into the space being heated because of leakage past that seal, when high static air pressures are maintained inside the heater.

SUMMARY OF THE INVENTION

Accordingly, it is an object of the present invention to provide an improved combustion chamber construction for a hot-air heater.

A further object of the invention is to provide a combustion chamber construction which substantially eliminates leakage of combustion products from the combustion chamber into the space being heated.

Still another object of the invention is to provide a combustion chamber of this type having metal to metal contact with attachment welds between the rear end of the combustion chamber and the rear header sheet to maintain lowest possible stresses and reduce the potential for failure at this location.

Still another object of the invention is to provide a combustion chamber construction which can undergo temperature cyclings for a prolonged period while still maintaining its fluid-tight integrity.

A further object of the invention is to provide a combustion chamber construction which requires a minimum number of formed parts.

Other objects will, in part, be obvious and will, in part, appear hereinafter.

The invention accordingly comprises the features of construction, combination of elements and arrangement of parts which will be exemplified in the following detailed description and the scope of the invention will be indicated in the claims.

Briefly, the combustion chamber construction of this invention includes a tubular combustion chamber preferably made of stainless steel. The rear end of the combustion chamber, which is the hotter end in use, is formed with a circular array of closely-spaced, axially-extending integral tabs or teeth. Also, a circular ring having a round cross-section is shrunkfit onto the combustion chamber at a location spaced axially somewhat from the roots of the tabs, the fit between the ring and the chamber being sufficiently tight that the chamber wall is actually radially deformed or necked-down appreciably by the ring, thereby providing a fluid-tight joint between those two elements.

The toothed end of the combustion chamber is relatively loosely received in an opening in a sheet header forming part of the overall heater with the circular ring butting against the header sheet all around the chamber. Then the ring is welded to that header sheet with the weld bead extending continuously between the two members all around the combustion chamber so that a fluid-tight joint is created between the ring and the header sheet. The tabs on the combustion chamber which now project through the opening in the header sheet are bent radially outward so that they engage the header sheet on the opposite side thereof from the ring at spaced-apart locations all around the combustion chamber. Thus there is maximum surface-to-surface contact between the tabs at the hot end of the combustion chamber and the coller header wall so that the heat in the chamber end is dissipated in the header sheet thereby minimizing stresses on that end of the chamber.

The spacing between the shrunkfit ring and the roots of the tabs are more or less the same as the thickness of the header sheet so that when the teeth are bent out and abut the header sheet as aforesaid, the roots of the tabs are more or less flush with the face of the header sheet. The individual tabs are then welded along one or more edges thereof to the header sheet. Thus unlike the prior constructions described above, the only parts of the combustion chamber extending through the header sheet are in good heat exchange contact with the cooler surface of that latter member. Also, the rear end of the chamber is secured to the header sheet not only on one, but on both sides thereof thereby preventing lengthwise movement of the rear end of the chamber.

The forward, cooler end of the combustion chamber projects out through an opening in a heater casing and its end is flanged to facilitate attachment of a gasketed circular plate which is bolted to the flange to close and seal the forward end of the combustion chamber. A flanged annular clamping ring engages around the combustion chamber at a location spaced axially from its flanged end, a suitable annular seal being provided between the clamping ring and the combustion chamber. The clamping ring is secured to suitable heater support structure by a plurality of rods whose opposite ends are connected to the clamping ring and the support structure respectively so that the combustion chamber as a whole is maintained in a substantially horizontal position.

While the ring supports the combustion chamber forward end, it permits that end to slide axially when the chamber is heated and cooled during operation of the heater. Its gasket inhibits escape of air from inside the heater into the space being heated. Preferably, as an additional safeguard against such leakage, a circular ring whose cross-section is in the shape of an angle iron is secured at one edge to the clamping ring by a continuous circular weld bead. Captured between the combustion chamber and the crook of the angle iron ring is a gasket in the form of a rope made of a suitable heat-resistant material such as asbestos. The gasket is squeezed between the ring and the chamber wall so as to prevent leakage of air inside the heater past the clamping ring into the living space even though the air has a relatively large pressure head as is the case with the air inside some heaters fitted with my combustion chamber.

Thus in the present arrangement, the hot end of the combustion chamber is supported so that all lengthwise movement of that end is inhibited as the chamber expands and contracts during temperature cyclings. Rather, all lengthwise motion is forced to occur at the forward end of the combustion chamber by relative motion between the forward end and its supporting clamping ring which is outfitted with a special rope gasket to ensure against air leakage as such sliding motions occur. Any expansions and contractions of the hot end of the combustion chamber in the radial direction are reflected in a greater or lesser necking down of that chamber end where it is engaged by its ring. Consequently, stresses on the weld bead between the ring and the sheet header are minimized, even as the fluid-tight integrity of the joint between the combustion chamber and the header sheet is maintained.

Further, the integral teeth or tabs on the combustion chamber end and the circular ring, capture the header sheet between them further minimizing stresses on the weld bead connection between the ring and the header sheet. The teeth also dissipate the heat at the hot end of the chamber to the cooler header sheet and prevent the combustion chamber end from sagging at high temperatures. Further, they prevent the hot end of the chamber from moving and possibly pulling out of the header sheet in the event of excessive longitudinal contractions of the chamber. Yet with all of these advantages, the present combustion chamber is relatively easy to install in a hot air heater. Accordingly, it should find wide application in heaters of the warm and hot air varieties.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 1:
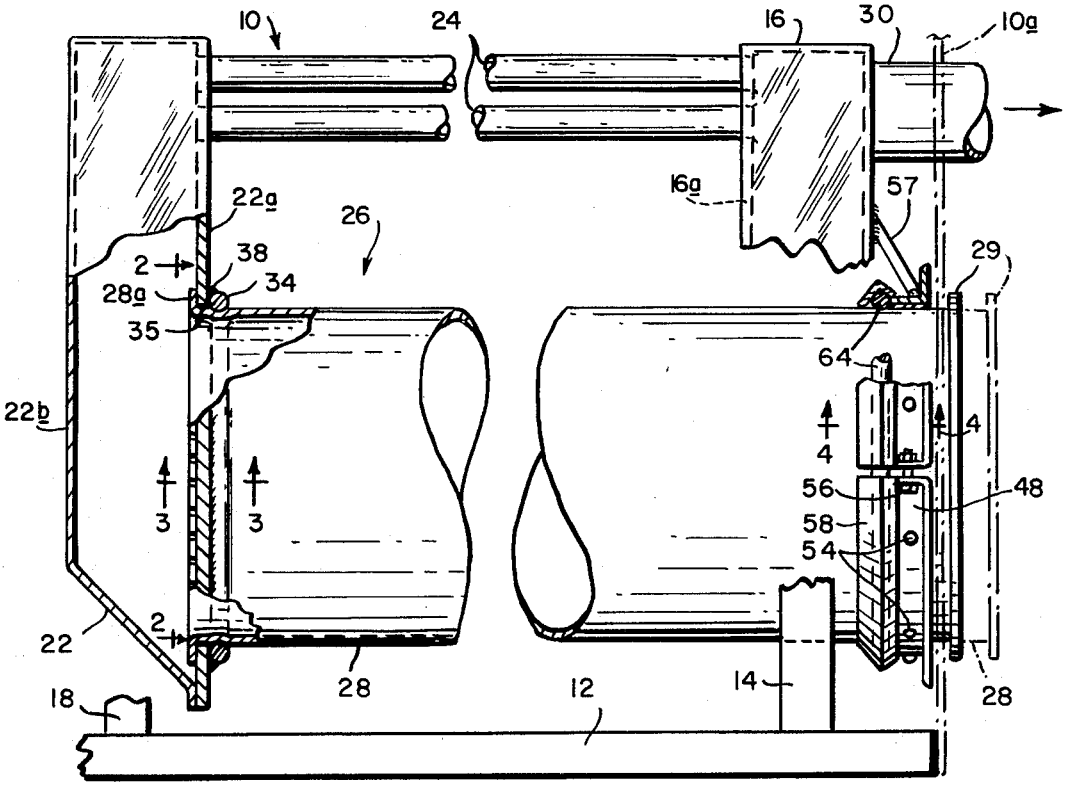
FIG. 1 is an elevational view with parts broken away showing a hot air heater incorporating a combustion chamber made in accordance with this invention.

Turning to FIG. 1 of the drawing, a warm air heater indicated generally at 10 has a base 12, and an upstanding front support structure 14 which supports a header 16. Also projecting up from base 12 is rear support structure 18 which supports a rear header 22. An array of heat exchange tubes 24, only two of which are shown, extend between the headers with their ends opening into those headers through their opposing walls or sheets 16*a* and 22*a* respectively.

Positioned directly below the heat exchange tubes is a generally horizontal combustion chamber shown generally at 26 made in accordance with this invention. Chamber 26 is in the form of a cylindrical tube or shell 28 and is preferably made of stainless steel (e.g. #309, 14 gauge) so that it can withstand the high temperatures (e.g. 1600° F.) and corrosive gases incident to combustion inside the chamber. The headers being subjected to lower temperatures are usually made of less expensive carbon steel. The rear end of chamber 26 is supported by the rear header wall 22*a* and communicates with the interior of header 22. The forward end of the chamber extends under header 16 and projects out through the heater casing wall shown in dotted lines at 10*a* in FIG. 1. That chamber end is supported by the support structure 14 as will be described later. The chamber forward end is closed by a circular plate 29.

In use, the combustion chamber is heated by suitable means such as a gun-type oil burner (not shown) firing into the chamber through its plate 29. The hot products of combustion also pass up through header 22 and along heat exchange tubes 24 to header 16 where they are vented to the atmosphere through a flue pipe 30 communicating with the header 16 through its wall 16*b*. Air is drawn into the heater 10 near its bottom by means of a suitable blower and is routed up around combustion chamber 26 and around the heat exchange tubes 24, the air being heated in the process. Near the top of the heater 10, that air is discharged directly or by way of ducting into the space being heated. As the heater 10 is turned on and off in order to maintain the selected space temperature, the combustion chamber 26 is heated and cools. Accordingly, the present chamber construction provides for the expansions and contractions incident to such temperature cyclings of the chamber.

Figure 2:
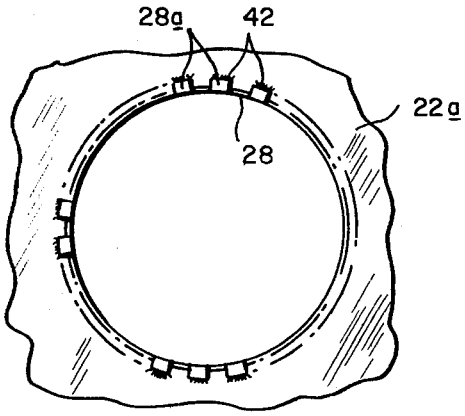
FIG. 2 is sectional view along line 2—2 of FIG. 1.
Figure 3:
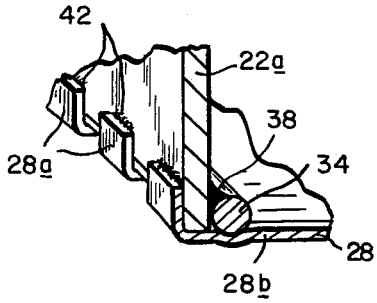
FIG. 3 is a sectional view along line 3—3 of FIG. 1.

More particularly and referring now to FIGS. 1 to 3, the rear end of the combustion chamber shell 28 is formed with a circular array of integral, spaced-apart, initially axially extending, relatively long tabs or teeth 28*a*. Also, spaced axially from the roots of teeth 28 by a distance more or less equal to the thickness of header sheet 22*a* is a ring 34 having a round cross-section and which extends all around the shell 28. Ring 34 is made of a strong material such as mild steel and it is shrunkfit onto shell 28 so that the shell region 28*b* opposite the ring is radially contracted or necked down as best seen in FIG. 3.

When installing the combustion chamber, the toothed end of shell 28 is inserted through the opening 35 in header sheet 22*a* so that the ring 34 abuts the header sheet all around the opening. The round ring 34 is then permanently secured to the header sheet by a continuous weld bead 38 preferably of mild steel which extends all around the ring. The teeth 28*a* are then bent radially outward so that they engage the header sheet 22*a* on the opposite side thereof from ring 34 and the end of each tooth now positioned radially outboard of the ring is permanently secured to the header sheet by weld beads 42. Thus, as shown in FIG. 3, the securement of the teeth 28*a* to the sheet 22*a* in this fashion provides large area, surface-to-surface heat exchange contact between the hot end of the combustion chamber and the cooler header sheet 22*a*. Therefore, that end of the chamber is kept relatively cool so that potentially fracturing stresses are not developed which could shorten the overall life of the chamber and thus the heat exchanger as a whole. This is in sharp contrast to the prior arrangements which have edge contacts between the chamber end and the rear header sheet.

Also as best seen in FIG. 3, the header sheet 22*a* is captured between the supporting ring 34 and teeth 42 all around the combustion chamber. This prevents any appreciable lengthwise movement of the rear end of the combustion chamber relative to the header sheet 22*a* due to lengthwise expansion or contraction of the shell 28 as it is being cycled between its temperature extremes during operation of heater 10.

More particularly, lengthwise expansion of the chamber at its rear end is prevented by the ring 34 which abuts the header sheet. When the chamber is heated, it expands radially as well as lengthwise. The radial expansion causes the chamber to expand radially around the lesser expanding ring. Therefore it conforms to the inner arc of the ring to an ever increasing extent so that lengthwise motion of that end of the heating chamber is increasingly inhibited. On the other hand, when the rear end of shell 28 tends to contract lengthwise upon cooling, the teeth 28*a* prevent that. Since the teeth are bent at right angles at the edge of opening 35, the tensile force exerted by the shell 28 is exerted against faces of the teeth rather than directly on the weld beads 42 between the teeth ends and the header sheet 22*a*.

The elimination of such lengthwise movement of the shell materially reduces stresses on the weld bead 38 between the support ring and the header so that there is little tendency for that bead to fracture and possibly permit leakage of combustion gases from the header 22 of chamber 26 into the fresh air stream circulated through the heater 10. The inclusion of the integral teeth welded to the header also prevents or eliminates any possibility of the shell 28 pulling out of the header sheet 22*a* and falling down even if some lengthwise contraction of shell 28 should occur. Finally, the integral teeth welded to the header 22*a* provide firm, all-around support for shell 28 so that it has no tendency to sag at high temperatures which the larger diameter shells are wont to do.

Although the rear end of the combustion chamber 26 is fixed against lengthwise expansion and contraction, the chamber, ring and header do expand and contract radially. However, as noted above, the header sheet 22*a*, support ring 34 and the weld bead 38 between the two are composed of similar materials having similar coefficients of thermal expansion. Accordingly, those elements expand and contract together so that a minimum amount of stress is placed on the weld bead 38. On the other hand, the radial expansions and contractions of the shell 28 which has a thermal coefficient larger than the ring and header are accommodated by the shell region 28*b* radially inboard of ring 34.

More particularly, when the shell is heated, it is ductile enough so that it can expand radially but to a lesser degree in the region 28*b* than in the regions at each side of the ring because of the constriction afforded by the lesser expanding ring. Consequently, in the region 28*b* the motion of the shell is more or less in a direction conforming to the engaging ring wall. The axial force components exerted on opposite sides of the ring by the radially expanding shell offset one another, while the radial force components are opposed by the weld bead on the radially outboard side of the ring which acts as an abutment and causes the "flow" of the shell material about the ring. Resultantly, a minimum amount of stress is imparted to the weld bead 38 that might tend to pull it away from header sheet 22*a*. At the same time, the joint between the ring 34 and the shell 28 becomes even more secure against fluid leakage because of the increased conformation of the shell region 28*b* about the ring 34.

On the other hand, when the shell 28 contracts radially upon cooling, the inherent "memory" of the resilient shell material causes the shell to contract in the region 28*b* underlying and immediately adjacent to the ring so as to restore its original radius. Resultantly, such contraction does not place a strain on the weld bead 38 nor upset the sealing engagement between the shrunkfit ring and the shell wall. Thus the rear joint construction between the combustion chamber shell 28 and the rear header 22 maintains its structural and fluid-tight integrity despite repeated cyclings of the combustion chamber.

Figure 4:
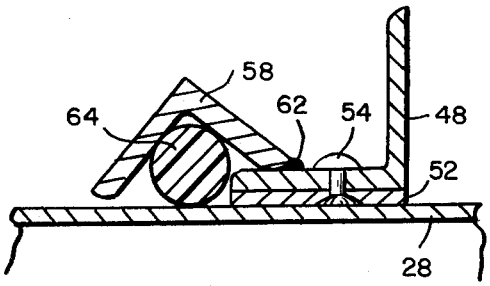
FIG. 4 is a sectional view along line 4—4 of FIG. 1.

Referring now to FIGS. 1 and 4, the shell 28 is supported at its forward end by means of a split flanged clamping ring 48 whose flange abuts the inner face of heater casing wall 10*a*. The radially inner face of the clamping ring is provided with a strap-like gasket 52 which is secured to the ring by means of rivets 54 or other comparable means. The two ends of the ring are drawn together by a suitable fastener 56 (FIG. 1) which is tightened so that the ring firmly clamps shell 28 yet permits the shell to slide longitudinally to some extent relative to the ring. The ring is, in turn, supported so as to maintain the combustion chamber in a substantially horizontal position by means of a plurality of braces or struts 57 spaced around an upper segment of the ring, one end of each brace being secured by welding to the ring and the opposite end thereof being welded to the header sheet 16*b* or the support structure 14.

To further minimize any likelihood of air leakage past ring 48, a second split ring 58 having a cross-section in the form of an angle iron is continuously welded along one edge by weld bead 62 to the radially outer surface of the clamping ring 48. The ring 58 is oriented so that it forms an inverted V just beyond the inner edge of the clamping ring. Entrapped between the split ring 58, the shell 28 and the end of the clamping ring 48 is a resilient gasket 64 made of asbestos rope or other comparable heat resistant material. The gasket is wedged between the surfaces of the two rings and the shell, thereby forming a very effective fluid-tight seal which prevents the escape of the pressurized air inside the heater casing past ring 48 into the space being heated, yet permits longitudinal expansion and contraction of the shell 28 relative to ring 48.

It will be appreciated from the foregoing, then, that my chamber construction substantially reduces the stresses on the mechanical connection between the chamber shell and the rear header, while ensuring fluid-tight integrity of the joint between the shell and that header during normal operation of the heater 10. Likewise, the provision at the forward, cooler end of the shell of the angle iron ring 58 welded to the support ring 48 for entrapping the flexible gasket 64 between the rings and the shell wall ensures a fluid-tight seal all around the chamber even as the shell 28 slides relative to the rings in response to temperature cyclings of the heater. Yet the manufacturing cost of the present construction should be less than those of prior comparable combustion chambers, typical ones being described above.

It will thus be seen that the objects set forth above, among those made apparent from the preceding description are efficiently attained, and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

What is claimed as new and desired to be secured by Letters Patent of the United States is:

1. An improved combustion chamber construction comprising a cylindrical shell made of a corrosive-resistant metal, a circular array of integral longitudinal teeth formed at one end of the shell, a metal ring having a circular cross-section shrunkfit onto the shell at or near the roots of the teeth, a header sheet made of a metal different from the shell metal and having a thermal coefficient of expansion similar to that of the ring, means defining an opening in the header sheet for receiving said one shell end whereby said ring abuts one face of the header sheet while the roots of the teeth are disposed at or near the opposite face of said sheet, a continuous weld bead extending between the ring and the one header sheet face all around the ring, said weld bead being composed of a metal having a coefficient of thermal expansion similar to that of the ring and the header sheet, said teeth being bent radially outward at the opposite sheet face and being in intimate relatively large area thermal heat exchange contact with that face, and a series of welds connecting the teeth to said opposite sheet face radially outboard of the ring.

2. The combustion chamber construction defined in claim 1 wherein the shell is made of stainless steel and the header sheet is made of carbon steel and the ring and weld beads are made of mild steel.

3. The combustion chamber construction defined in claim 1 and further including a clamping ring engaging around the opposite end of the shell, means for supporting the clamping ring, a second ring having an angle iron cross-section encircling the clamping ring so as to form with the clamping ring and shell a toroidal enclosure, a continuous weld bead connecting an edge of the second ring and the clamping ring and an annular gasket made of a heat-resistant material captured in the enclosure, said gasket extending all around the shell to provide a fluid-tight seal between the second ring and the shell while permitting lengthwise sliding movements of the shell relative to the clamping ring.

* * * * *